United States Patent [19]

Goodrich et al.

[11] Patent Number: 4,809,393

[45] Date of Patent: Mar. 7, 1989

[54] ELECTRICAL APPLIANCES INCLUDING A CORD LOCK

[75] Inventors: Gordon W. Goodrich; Henry J. Rosendall, both of Grand Rapids, Mich.

[73] Assignees: Amway Corporation, Ada; Bissell Inc., Grand Rapids, both of Mich. ; a part interest

[21] Appl. No.: 87,433

[22] Filed: Aug. 20, 1987

[51] Int. Cl.[4] ..... A47L 9/26; B65H 75/36

[52] U.S. Cl. ..... 15/323; 15/DIG. 10; 242/85.1

[58] Field of Search ..... 15/323, 327 R, 327 F, 15/410, DIG. 10; 242/85.1

[56] References Cited

U.S. PATENT DOCUMENTS

| | | | |
|---|---|---|---|
| 1,670,715 | 5/1928 | Doherty | 15/DIG. 10 |
| 1,746,246 | 2/1930 | Elworthy | 15/DIG. 10 |
| 1,759,947 | 5/1930 | Lee | 15/351 X |
| 2,037,668 | 4/1936 | Smith et al. | 15/323 X |
| 2,193,989 | 3/1940 | Smellie | 15/DIG. 10 |
| 2,946,071 | 7/1960 | Nilsson | 15/323 |
| 4,062,430 | 12/1977 | Momberg | 15/DIG. 10 |
| 4,571,772 | 2/1986 | Dyson | 15/335 |

FOREIGN PATENT DOCUMENTS

| | | | |
|---|---|---|---|
| 554751 | 1/1957 | Italy | 15/323 |

*Primary Examiner*—Harvey C. Hornsby
*Assistant Examiner*—Stephen F. Gerrity
*Attorney, Agent, or Firm*—Price, Heneveld, Cooper, DeWitt & Litton

[57] ABSTRACT

An electrical appliance including an electric cord, and a cord lock comprising a rotatable body provided with a handle radially extending therefrom and an oppositely extending cam provided with a shoulder. In a first position, the handle extends upwardly and the cord lock functions in a storage capacity for the entire cord. In a second position, the cam portion extends upwardly and the shoulder automatically retains only one loop of the cord. The rest of the loops in this position are released by an inclined surface provided on the cam. In a third position, the body is rotated so that the handle extends horizontally. At this position, all of the loops may be collectively removed from the cord lock by the user.

4 Claims, 2 Drawing Sheets

ELECTRICAL APPLIANCES INCLUDING A CORD LOCK

BACKGROUND OF THE INVENTION

The present invention relates generally to a cord lock for selectively holding the electric cord of an electrical appliance such as an upright vacuum cleaner, floor polisher, extractor or the like and more particularly to a cord lock having a rotatable handle for alternately gathering a plurality of cold loops, a single cord loop or releasing all cord loops.

Electric vacuum cleaners are exemplary of such common floor cleaning appliances employed universally in home and business uses. Vacuum cleaners are normally operated by electric current obtained from a conventional electric socket provided in the wall, floor or the like of the home or office. The electricity is supplied to the vacuum cleaner via the use of a relatively long cord that plugs into the electrical socket.

Most upright vacuum cleaners are provided with hooks near the top and bottom of the vacuum cleaner, so that the cord may be looped around the hooks for storage. In this way, the cord may be stored in an easy and compact manner. When the vacuum cleaner is to to used, the cord may be unwrapped loop by loop starting with the plug end of the cord. Prior artisans have also provided at least one rotatable hook, which upon rotation allows for all of the cord loops to be removed at once.

In the operation of the vacuum cleaner, the vacuum is rolled along the floor space needing to be vacuumed. Often the user moves the vacuum cleaner in a to-and-fro motion until the entire floor has been vacuumed clean. The cord provided is relatively long so that the vacuum cleaner may reach a large amount of the floor space before it is necessary to plug the cord into a different socket. In using the vacuum cleaner, the cord generally lies on the floor and often gets in the way of the vacuum cleaner's path. The user is constantly having to move and adjust the cord so that the vacuum cleaner may move smoothly on the floor without running over the cord. This slows the vacuuming procedure and burdens the user since he must continually interrupt the operation to bend over and move the cord.

In an attempt to rectify this problem, many users have taken to holding the cord in one hand, so that they can avoid the interruption that would otherwise be involved in moving the cord. However, by so holding the cord, the user's hands are occupied with one hand on the vacuum cleaner and one holding the cord. With the user's hands thus occupied the user has a limited ability to carry out other functions during the vacuuming operation. For example, the user cannot easily swing doors, move light furniture or plants that would facilitate an easy, efficient vacuuming of the entire room. To attempt to do this while holding the cord may inadvertently move the cord in the vacuum cleaner's path, limit one's reach or limit hand dexterity to an extent that makes some items difficult to grasp and move. Moreover, if the user ever lets go of the cord to free his hand or to leave the vacuum cleaner momentarily, the cord drops to the floor requiring the user to again bend over and pick up the cord upon continuation of the vacuuming operation.

SUMMARY OF THE INVENTION

According to the preset invention, these and other problems in the prior art are solved by provision of a cord management system. The cord management system is effected by a rotatably mounted cord lock which is adjustable to at least two different positions: a first position in which the cord lock operates as a typical hook and allows the cord to be looped around for convenient storage, and a second position in which the cord lock holds only one loop of the cord and releases the other loops, whereby the cord is held off the floor and out of the way during use of the appliance. In a preferred embodiment, there is a third position providing for the removal of all of the cord loops.

The user, by employing this invention, no longer needs to keep bending over to move the cord out of the vacuuming path. The cord is kept out of the vacuuming path without encumbering the user's free hand. Hence, the user can freely swing doors or move light furniture or the like without being concerned about the cord in his hand. This again makes for a quicker, more efficient and easier vacuuming operation for the user. Also, if the user leaves the vacuum cleaner momentarily or at times needs to additionally adjust the cord's position, the invention supports the cord up off the floor in easy reach of the user.

These and other objects, advantages and features of the present invention will be more fully understood and appreciated by reference to the written specification and appended drawings.

DETAILED DESCRIPTION OF THE PREFERRED EMBODIMENT

Figure 1:
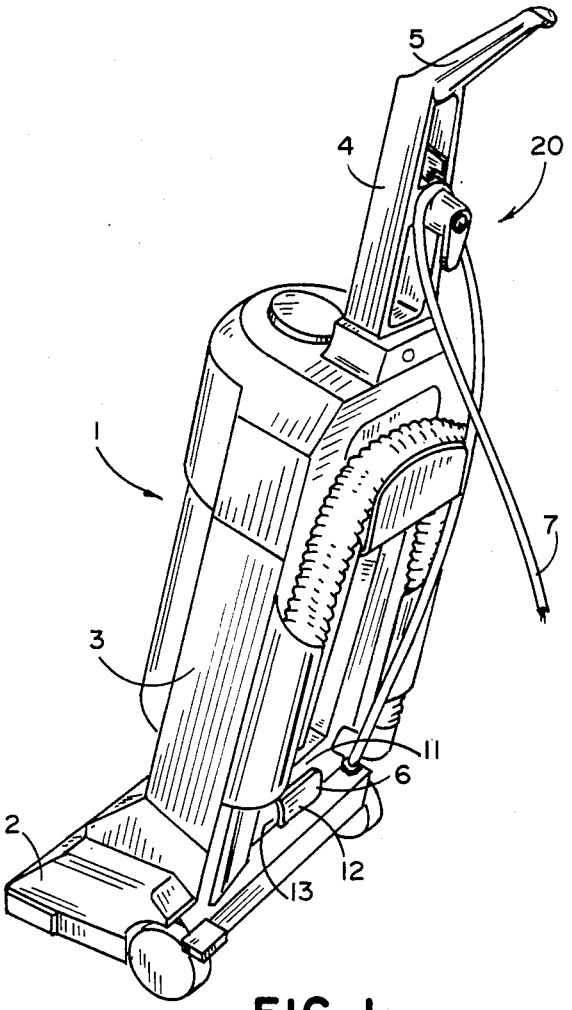
FIG. 1 is a perspective view of a vacuum cleaner constructed according to the present invention with a cord lock rotatably positioned to hold only one loop of the electric cord in an operative position.

Referring to the Figures and in particular FIG. 1, in a preferred embodiment of the invention, a cord lock generally illustrated by the numeral 20 is mounted to an upper portion of a vacuum cleaner generally illustrated by the number 1. In this case, the cord lock is mounted on the upwardly projecting handle stem 4. Cord lock 20 includes a rotatable body 21 with a handle 25 projecting radially therefrom in one direction and a cam 30 projecting radially therefrom in the opposite direction. When cord lock 20 is rotated to its first position (FIG.

2) handle 25 is oriented upwardly so as to provide an upper hook for receiving a looped cord 7. Rotated to a second position (FIGS. 1 and 3) with cam 30 up and handle 25 down, all but one loop of cord 7 are removed, with one loop being locked in place at the top of vacuum cleaner 1 by cord lock 20 (FIG. 1). By rotating cord lock 20 90° to a third position, with cam 30 and handle 25 oriented horizontally (FIG. 4), looped cord 7 can be completely removed.

Figure 2:
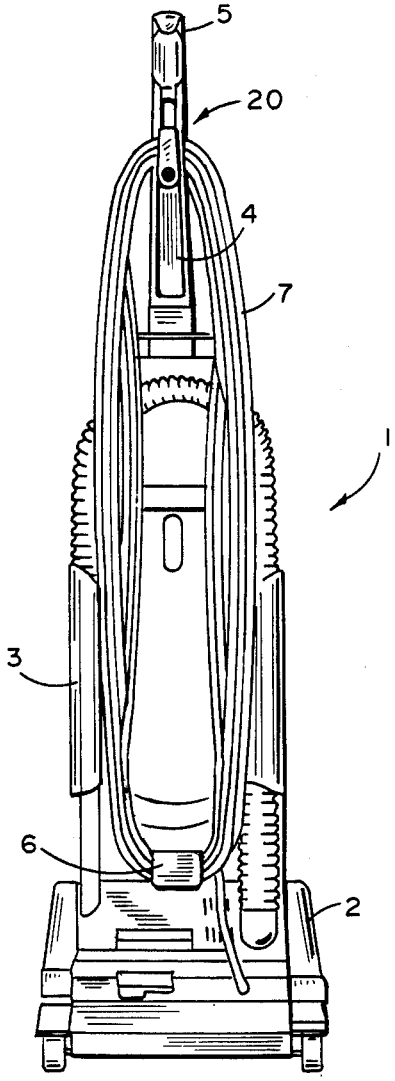
FIG. 2 is a rear elevational view of a vacuum constructed according to the present invention with the cord lock rotatably positioned to hold all of the loops of the electric cord in a stored position.

Vacuum cleaner 1 comprises a base portion 2 that supports the vacuum cleaner and rolls along the floor while the vacuum cleaner is in use. Above the base is an intermediate, upright body portion 3 and a handle 5 shaped for grasping by the user, joined to body 3 by vertically oriented stem 4. Also, as illustrated in FIGS. 1 and 2, the vacuum cleaner includes an electric cord 7 for connecting the vacuum cleaner to a wall socket (or the like) to thereby power the vacuum cleaner. The cord 7 is stored by wrapping the cord around lock 20 in its upper position and a lower cord wrap hook 6 secured to the bottom of vacuum cleaner body 3.

Figure 6:
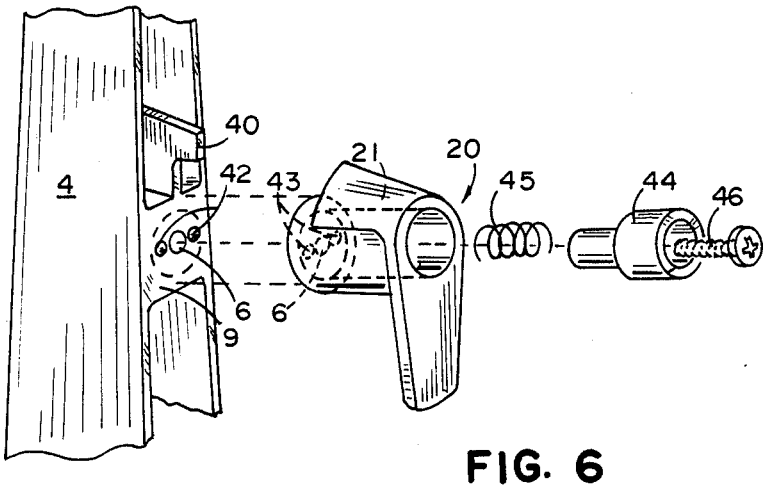
FIG. 6 is an enlarged, exploded, perspective view of the present invention.

Cord lock 20 is formed from a rigid material, preferably a rigid plastic material. As can best be seen in FIGS. 3–5, cord lock 20 comprises a body 21 mounted to and projecting outwardly from the rear face 9 of handle stem 4. Body 21 is rotatably mounted to stem 4 by a threaded fastener or the like. Body 21 is rotatable about an axis 50 that is substantially perpendicular to the longitudinal axis 60 of stem 4. With reference now also to FIG. 6, threaded fastener 46 is provided to rotatably mount the cord lock body 21 to the handle stem 4. A coil spring 45 is compressed between the cord lock body 21 and a bushing 44 through which the threaded fastener 46 extends. This spring biases the cord lock body against the face 9 of the handle stem 4. The face 9 is provided with a pair of rounded projections 42 which normally mate with a pair of sockets 43 disposed on the inner face 23 of the abutting cord lock body 21. This provides a detent which registers the cord lock body in either the upright first position where it acts as a cord lock hook or the downwardly directed second position where a single loop of cord 7 is trapped between the cord lock and the handle stem as illustrated in FIG. 1.

Figure 5:
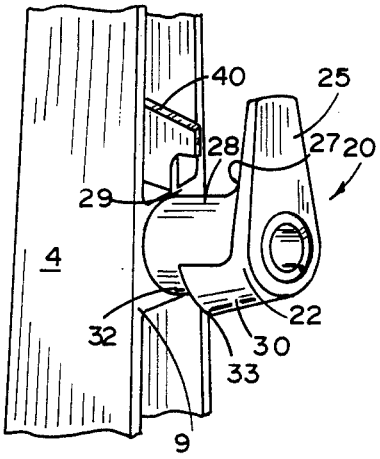
FIG. 5 is an enlarged perspective view of the present invention where the cord lock body is rotated to the position illustrated in FIG. 2, again with the cord omitted for the sake of clarity.

On an end opposite inner face 23, body 21 is provided with a free or distal end 22. From distal end 22 the handle 25 extends radially. Handle 25 has an inner surface that serves as a first abutment or shoulder 27 as will be explained below. As illustrated in FIG. 5, body 21 may be rotated to a first position wherein handle 25 extends upwardly. Body 21 further includes an arcuate first surface 28 which extends between handle 25 and inner face 23. Hence, in this first position, first surface 28 is on the upward side of body 21.

As can be seen in FIGS. 1 and 2, vacuum cleaner 1 includes, on a lower portion, a lower hook 6. The lower hook is generally L-shaped and includes a generally horizontal flange 11, a generally vertical flange 12 and an L-shaped lower surface 13. Lower hook 6 lies beneath the cord lock 20. with body 21 rotated to its first position, as illustrated in FIGS. 2 and 5, it cooperates with the lower hook 6 so that cord 7 can be wrapped or looped around the lower hook 6 and body 21 or cord lock 20. More specifically, cord 7 wraps around lower surface 13 of lower hook 6 and first surface 28 of body 21. The loops on cord lock 21 are trapped between shoulder 27 and rear face 9. Note also, that in this position, first surface 28 is inclined so as to slope downward toward stem 4. Because of this construction, one loop of cord 7 will always be cammed into the corner 29 formed by first surface 28 and rear face 9 of stem 4 when cord 7 is looped into its storage position. This provides for the automatic entrainment of a single cord loop between the shoulder 31 and the inner face 9 of the stem 4 when the cord lock body 21 is rotated to the second position where a single loop of cord is retained.

Body 21 includes cam 30 on the side opposite first surface 28. Cam 30 extends radially outward in a direction opposed to the extension of handle 25, and extends along the length of body 21 from the distal end 22 to a point 33 just short of stem 4. At point 33 body 21 includes a surface forming an abutment shoulder 31. Shoulder 31 is substantially parallel to rear face 9 and therewith defines a gap 34. Gap 34 is sized slightly larger than the width of cord 7 so that cord 7 may be loosely received therein. Note also, that shoulder 31 is slightly higher than the width of cord 7. Provided on body 21, opposite first surface 28 and between inner face 9 and shoulder 31, is an arcuate second surface 32. Second surface 32 extends from shoulder 31 to inner face 9.

Figure 3:
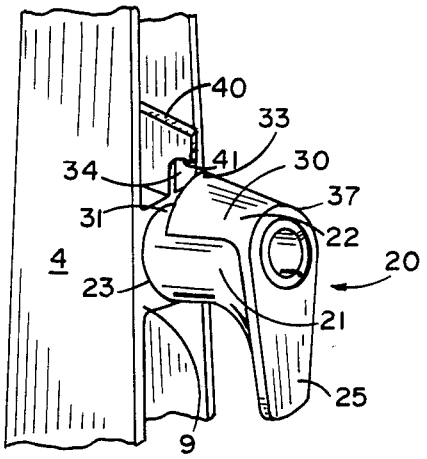
FIG. 3 is an enlarged perspective view of the present invention wherein the cord lock is rotated to the position illustrated in FIG. 1, with the cord omitted for the sake of clarity.

Cord lock 20 is rotatable to the second position, 180° from the first position, so that cam 30 is extending upwardly (FIG. 3). In this position, second surface 32 also faces upwardly and, as illustrated in FIG. 1, is used to support one loop of cord 7. Note that the one loop of cord 7 is retained in gap 34 while the other loops are released, sliding readily off of downwardly, rearwardly sloping cam 30.

Cam 30 is provided with an arcuate third surface 37 which extends from the distal end 22 of body 21 to shoulder 31. Third surface 37 is inclined so that it slopes downward and out when cord lock 20 is rotated to its second position (FIG. 3). This inclination causes all of the loops, but the one retained in gap 34, to be released from cord lock 20. Note also, that the arcuate second surface 32 and third surface 37 are shaped to blend with the arcuate first surface 28 so that the outer surface of the rotatable body is continuous (except for shoulder 31).

Cord lock 20 is constructed to cam the single loop of cord 7 into gap 34 when body 21 is rotated from its storage (first) position, as shown in FIG. 2, to its operative (second) position, as shown in FIG. 1. When cord 7 is stored, body 21 is positioned in the first position (as seen in FIGS. 2 and 5). The user then wraps or loops cord 7 around lower hood 6 and first surface 28 of body 21. In the storage position, one cord loop tends to locate in corner 29 due to the first surface's downward inclination toward stem 4. When the user desires to operate the vacuum cleaner he rotates body 21 180° to its second position (shown in FIG. 1). As body 21 is rotated, the one cord loop that was positioned in corner 29 is restrained by shoulder 31. Due to the size of gap 34 only one cord loop is retained therein. The remaining loops of the cord will fall to the floor due to the downward inclination of the third surface 37 away from stem 4. Cord 7 may now be plugged into the wall socket. Yet as discussed above, one cord loop is automatically held up off the floor in gap 34.

To ensure that one loop is retained in gap 34 and that the one loop to be held will not be released, an additional tab 40 projects outwardly in cantilevered fashion from the rear surface 9 of stem 4. Tab 40 is positioned to lie above the rotatable axis 50 of body 21. Tab 40 includes a lower surface 41 that projects outwardly from rear surface 9 of stem 4. Lower surface 41 is positioned directly above second surface 32 of body 21 when the body is rotated to its second position (FIG. 3). Lower surface 41 is also spaced from second surface 32 a distance slightly more than the width of cord 7, so that the one cord loop to be held is loosely received three between. Lower surface 41 extends outwardly from stem 4 approximately the same distance as does the second surface 32 of body 21. Hence, then body 21 is rotated to its second position (FIG. 3), gap 34 is almost completely surrounded and closed. This arrangement precludes the one loop of cord 7 from being inadvertently released from the cord lock as the vacuum cleaner is moved along on the floor.

Figure 4:
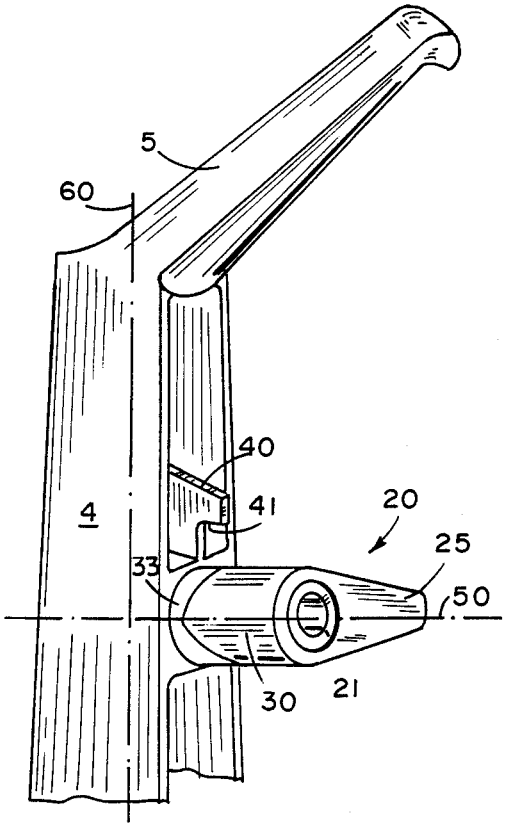
FIG. 4 is an enlarged perspective view of the present invention where the cord lock is rotated to its intermediate position which permits all of the loops of cord to be collectively removed.

As seen in FIG. 4, body 21 is rotatable to a third position which is intermediate the first and second positions. More specifically, the third position is 90° from either of the first and second positions. In the third position, handle 25 and cam portion 30 are positioned to extend horizontally. At this position, all off the cord loops are removed by the user; that is, the loops may be grasped by the user and easily moved around cam portion 30 and handle 25 for removal.

The invention therefore provides a three-fold function that eases the use of a vacuum cleaner. The invention's first function is to cooperate with a lower hook to easily store the cord in a compact looped fashion. This permits the cord to be quickly wrapped and held close to the vacuum cleaner in a convenient manner for storage.

A second function provided by the invention is that it will selectively hold one loop of the cord to an upper portion of the vacuum cleaner. This position operates to keep the cord out of the vacuuming path. By holding the cord portion nearest the vacuum cleaner up of the floor, the cord is much less likely to fall into the vacuum cleaner's path. This provides for a quicker and easier vacuuming procedure by the user, and obviates the need to bend over and pick the cord up off the floor, which in turn, reduces body stress and fatigue for the user.

The third function is to facilitate complete removal of cord 7 from cord lock 20. If the user desires to vacuum without utilizing the invention's single-loop holding feature, the invention still provides a quick and easy method of removing the cord from its stored position. The third position consists of rotating the cord lock body so that the handle is extending horizontally. At this position, all of the cord loops may easily be collectively grasped and removed from the hook. This again obviates the more rigorous and time-consuming unwrapping of the cord loop by loop.

The above description is considered to be that of the preferred embodiment only. Modifications of the invention will occur to those who make and use the invention. The true scope and spirit of the invention is to be determined by reference to the appended claims. It is desired to include within the scope of the invention all such modifications that come within the scope of the appended claims.

The embodiments of the invention in which an exclusive property or privilege is claimed are defined as follows:

1. An electric appliance having a handle, an electric cord and a cord lock, said cord lock comprising:

a body rotatably mounted to said handle for movement between a first operative position and a second operative position, said body further including a first surface for supporting a plurality of loops of said cord in said first operative position, an opposite second surface for selectably supporting a single loop of said cord in said second operative position, and a cam portion adjacent said second surface which extends radially outward beyond said second surface and thereby forms a shoulder between said cam portion and said second surface to restrict said single loop of said cord supported by said second surface from being released when said body is rotated to said second operative position, said first surface being inclined so as to slope downwardly toward said handle when said body is in said first operative position so that said single loop to be supported when said body is in said second operative position is urged to slide to an position adjacent said handle, said cam portion having a outer surface inclined to slope down and away from said handle when said body is in said second operative position such that rotation of said body from said first operative position to said second operative position results in the sliding release of all of the cord loops along said inclined outer surface of the cam portion but said single loop which is supported on said second surface between said shoulder and said handle, and wherein the height of said shoulder above said second surface and the lateral spacing of said shoulder from said handle are each substantially equal to the width of said cord, to thereby ensure that only said single cord loop is held when said body is rotated to said second operative position, and a tab fixedly mounted to said handle above said body, wherein said tab projects laterally outward from said handle and cooperates with said handle, said second surface and said shoulder to substantially enclose said supported single cord loop when said body is rotated to said second operative position.

2. The appliance of claim 1 in which said body includes a distal end and wherein a lock handle is attached to and extends radially outwardly from said distal end adjacent said first surface so that said lock handle restricts said plurality of loops supported on said first surface from being released therefrom when said body is rotated to its said first operative position.

3. The appliance of claim 1 further comprising a detent for selectively registering said body rotatably into said first operative position and into said second operative position.

4. The appliance of claim 3 wherein said detent further comprises at least one projection disposed on one of said handle and said body; at least one socket disposed on the other of said handle and said body; and spring biasing means for urging said body into engagement with said handle.

* * * * *